United States Patent [19]

McCarthy

[11] Patent Number: 4,569,215

[45] Date of Patent: Feb. 11, 1986

[54] EXTENDABLE KEY OPERATOR

[75] Inventor: Richard O. McCarthy, Copley, Ohio

[73] Assignee: Rena Taslitt, Lyndhurst, Ohio

[21] Appl. No.: 614,029

[22] Filed: May 25, 1984

[51] Int. Cl.[4] ..... A47G 29/10

[52] U.S. Cl. ..... 70/456 R; 70/459

[58] Field of Search ..... 70/456 R, 456 B, 459; 24/3 K; 150/40; D3/61

[56] References Cited

U.S. PATENT DOCUMENTS

| | | | |
|---|---|---|---|
| 1,885,957 | 11/1932 | Singleton . | |
| 2,482,623 | 9/1949 | Keminer . | |
| 2,583,961 | 1/1952 | Nash . | |
| 2,600,749 | 6/1952 | Gallagher . | |
| 2,637,994 | 5/1953 | Harrison . | |
| 2,836,053 | 5/1958 | Starrett | 70/456 R |
| 3,004,422 | 10/1961 | Starrett | 70/456 R |
| 3,355,917 | 12/1967 | Albert . | |

*Primary Examiner*—Robert L. Wolfe

*Attorney, Agent, or Firm*—Robert R. Hussey

[57] ABSTRACT

An extendable key operator which has a handle, an outer extension arm and an inner extension arm pivotally connected to the handle and the outer extension arm. The outer extension arm has a key retaining end portion. The arms are movable between a retracted position in which the arms are positioned adjacent to the handle and an extended position. In the extended position, the key retaining end portion and the arms are extended from the handle to allow a person to operate a key retained on the outer extension arm by grasping the handle. The handle is connected to the outer extension arm by one pulley connected to the handle, another pulley is connected to the outer extension arm and a belt is positioned around the pulleys. The pulleys have slots therein and the belt has complimentary cleats thereon. The cleats are positioned in the slots in the pulleys to synchronize and control the angular movement of the handle and the outer extension arm and lock the angular movement of the outer extension arm with respect to the handle. A locking member is movably mounted on the handle and has a locking projection. The inner extension arm has a first locking depression which receives the locking projection of the locking member when the operator is in the retracted position and a second locking depression which receives the locking projection when the operator is in the extended position. The pulleys, belt, locking member and locking depressions, lock the arms and the handle into a compact, rigid structure in the retracted position and an elongated, rigid structure in the extended position. In the extended position, the key may be used a distance from the hand of the person using the key operator.

18 Claims, 13 Drawing Figures

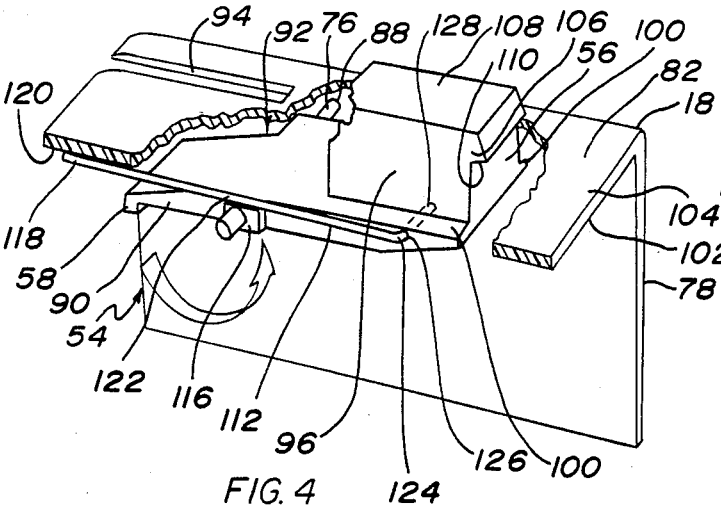
FIG. 4
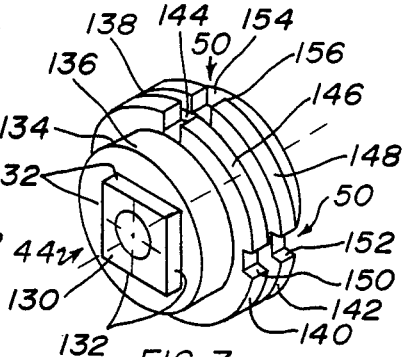
FIG. 7
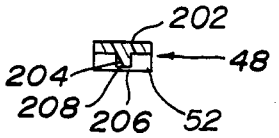
FIG. 13
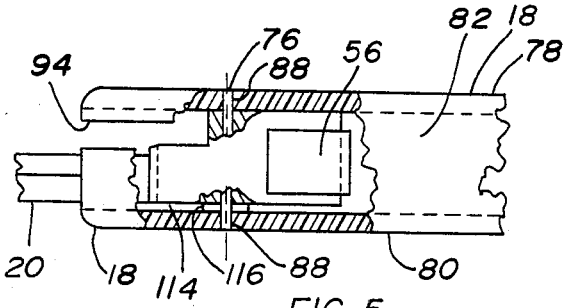
FIG. 5
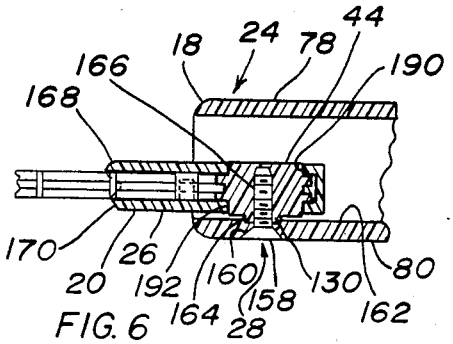
FIG. 6
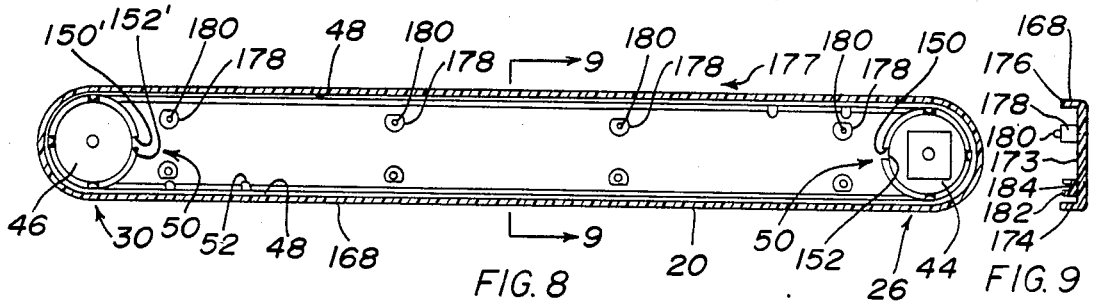
FIG. 8
FIG. 9
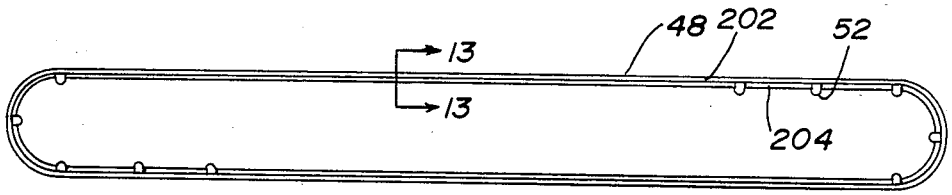
FIG. 12
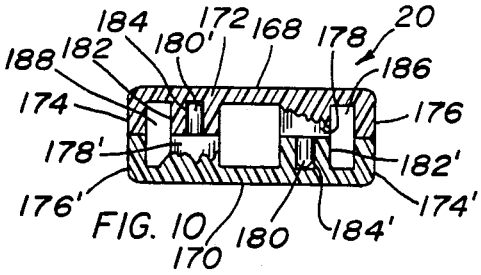
FIG. 10
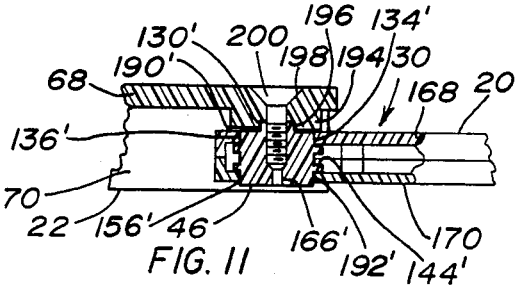
FIG. 11

EXTENDABLE KEY OPERATOR

BACKGROUND OF THE INVENTION

The present invention relates to an extendable key operator and more particularly to a hand held extendable key operator which allows a person to use a key a distance from his hand.

Periodically, it is necessary for a person to operate a key, such as a metal key or key card or the like, in a lock which is spaced a distance from his hand. For example, one such condition exists when a person desires to operate a lock from a car. In many instances, the lock is spaced a sufficient distance from the car so that it is difficult for a person to reach out of the car window and operate the lock with a key held in his hand. Rather, the person must either open the door of the car to reach the lock and partially exit the car to operate the lock with a hand held key, or move the car until the car is close enough to the lock so that the the person can stretch out of the car window to manually operate the lock. In some instances, barricades do not allow a person to move the car close enough to operate the lock and the person must then open the door in order to operate the lock. It is also desirable to provide a key operator which allows successful operation of a lock with a key a distance from a person whose stature, handicap or disability make it difficult to operate the lock with a hand held key.

In general, locks are installed for security and when a person is required to open his car door, the security of that person is decreased. In addition, when a person is forced to open the car door or even reach a substantial distance out of the car window, during undesirable weather conditions such as cold, snow, wind or rain, his arm and upper torso are exposed to the weather elements which may cause discomfort.

Accordingly, it is desirable to provide a key operator which allows a person to use a key a substantial distance from his hand. By extending the key a substantial distance from the person's hand, the person will not be required to extend his hand as far from the vehicle.

It is also desirable that the key operator be rigid in an extended position so that the key may be moved forward to insert and rotate the key in the lock a distance from the person's hand. The rigid key operator acts as an extension of the person's hand. This rigidity of the key operator allows a person to operate the key in the lock a distance from his hand.

It is also desirable that the key operator be collapsible to a storage or retracted position and be compact in size so that the key operator can easily be carried by a person such as in his pocket, purse, bag or the like or otherwise stored in a secure place, such as the glove compartment of a vehicle. This desirable feature of compact size in the storage position is converse to the desirable feature of substantial extension when the key operator is in the extended position described above. The more compact the key operator is in the storage position, the more easily it can be carried or stored. Conversely, the key operator must be extendable to a substantial distance from the persons hand when used to operate a lock.

It is also desirable that such a key operator be locked when in the storage or retracted position so that the components of the key operator are not loose when stored and subject to damage or an inconvenience for the person carrying the key operator.

It is also desirable to provide a key operator with simplified movement between the extended and the storage positions to decrease its size, weight, and cost of manufacture.

Known apparatuses provide for extending a key from a key pouch or holder. One such known apparatus is disclosed in Nash, et al, U.S. Pat. No. 2,583,961. Such an apparatus provides a key pouch with a "tong" linkage system. A key supporting plate with a number of loosely supported metal keys thereon is movable between a position in the pouch to a position just outside the end of the pouch so that the keys may be gripped by a person to operate a lock. In such a key pouch, the keys are not moved a substantial distance from the key pouch to operate a lock at a distance from the pouch. The keys are not mounted so as to be rigid in an extended position so that a key could be operated by a person holding the key pouch. Such a key pouch also does not meet the desirable feature of being compact when in the storage position. Furthermore, the "tong" linkage system has a number of different moving components which are subject to binding and does not provide a design which has a simplified movement of its components. Furthermore, the great number of components necessary in such a design does not meet the desirable feature of decreased size, weight, and cost of manufacture.

Other known apparatuses provide for the use of a handle with a sliding member on the handle and a key attached to the sliding member. The sliding member slides away from the handle to expose the concealed key. Such know apparatuses are disclosed in U.S. Pat. Nos. 1,885,957 and 2,482,623.

These known apparatuses operate to move a key from a stored position inside of a key case to a position outside of the key case by using a sliding member. These known devices do not provide for the use of a key a substantial distance from a person's hand. Furthermore, these designs do not allow for a substantial extension of the key from the case while still being compact in a storage position. Inherent in the use of a sliding member is that the key cannot be extended further than a portion of the length of the sliding member. For example, the key case in Kaminger U.S. Pat. No. 2,482,623 does not allow for extension of the key further than the length of the sliding member since a portion of the sliding member must be retained in the handle for securing the handle to the sliding member.

SUMMARY OF THE PRESENT INVENTION

The present invention provides the above-described desirable features with an improved extendable key operator which when in an extended position allows the person to use a key a substantial distance from his hand and when in a closed position, is compact. The extendable key operator of the present invention provides a handle, an outer extension arm, an inner extension arm pivotally connected to the handle and the outer extension arm. The outer extension arm has a key retaining end portion movable between a retracted or storage position and an extended position. In the storage position, the arms are positioned adjacent to the handle and in the extended position the key retaining end portion and the arms are extended from the handle to allow for operation of a key a substantial distance from the person.

The extendable key operator of the present invention provides means for locking the handle and the arms in both the storage and extended positions. The locking means includes a pulley connected to the handle, another pulley connected to the outer extension arm and a belt positioned around the pulleys. The pulleys have slots therein and the belt has cleats which are positioned in the slots of the pulleys. The pulleys and belt operate to synchronize and control the angular movement of the handle and the outer extension arm and lock the angular movement of the outer extension arm with respect to the handle.

To lock the inner extension arm with respect to the handle in both the extended and storage positions, the extendable key operator of the present invention provides a locking member which is movably mounted on the handle. The locking member has a locking projection which is movable between a locked and an unlocked position. The inner extension arm has a locking depression which receives the locking projection in the storage position and locks the inner extension arm with respect to the handle. The inner extension arm also has another locking depression which receives the locking projection of the locking member in the extended position and locks the handle and inner extension arm in the extended position. The pulleys, belt, locking member and locking depression operate to lock the arms into a rigid structure in the storage position and in the extended position so that a person can operate a key a distance from his hand.

The key operator of the present invention achieves the above-mentioned desirable features which allow a person to operate a key in a lock a substantial distance from his hand. The extendable key operator of the present invention also achieves the desirable feature of being compact in size when in a storage position which allows a person to easily transport or store the key operator. This compact feature is achieved by the use of a simplified means which connects the handle and extension arms of the key operator while allowing for simplified movement in operation of the key operator.

The present invention also achieves the above-mentioned desirable features of having decreased size, weight, and cost of manufacture.

BRIEF DESCRIPTION OF THE DRAWINGS

FIG. 4 is a perspective view of the locking member and its cooperating spring shown in FIG. 1;

FIG. 5 is a top view of a portion of the key operator shown in FIG. 3;

FIG. 6 is a partial cross-sectional top view of the key operator shown in FIG. 3 and taken along line 6—6 thereof;

FIG. 7 is a perspective view of a pulley of the key operator of the present invention shown in FIG. 1;

FIG. 8 is an expanded side elevational view of the inner extension arm of the key operator shown in FIG. 3;

FIG. 9 is a sectional view of the extension arm shown in FIG. 8 taken along lines 9—9 thereof;

FIG. 10 is a cross-sectional view of the inner extension arm shown in FIG. 3 and taken along lines 10—10 thereof;

FIG. 11 is a partial sectional view of the key operator shown in FIG. 3 and taken along lines 11—11 thereof.

FIG. 12 is a side elevational view of the belt of the key operator of the present invention shown in FIG. 1; and FIG. 13 is a cross-sectional view of the belt of the key operator shown in FIG. 12 and taken along lines 13—13 thereof.

DETAILED DESCRIPTION OF THE INVENTION

Figures 1, 2, 3:
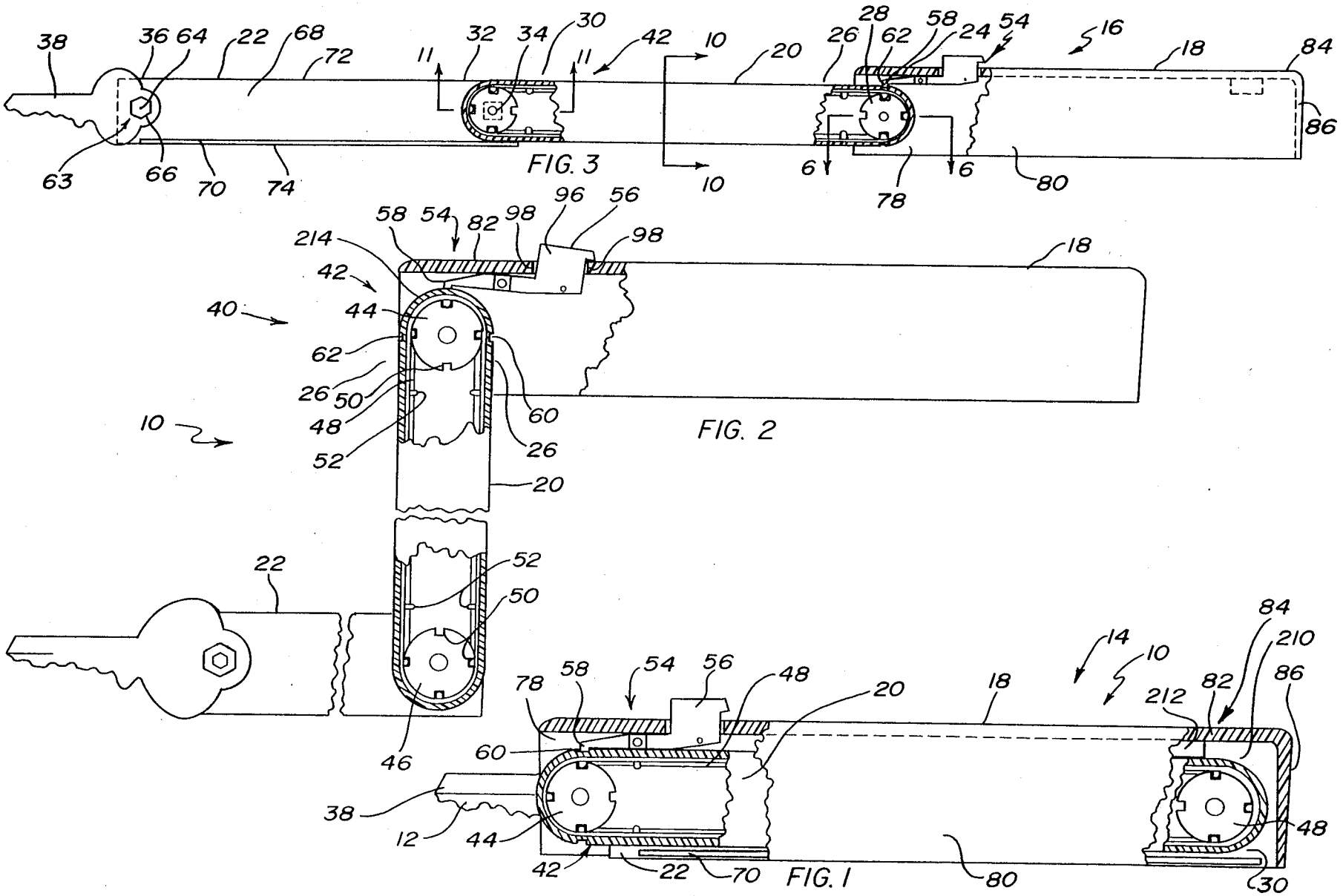
FIG. 1 is a partial cross-sectional, side elevational view of a key operator of the present invention in a retracted or storage position.
FIG. 2 is a partial cross-sectional, side elevational view of the key operator shown in FIG. 1 in an intermediate position.
FIG. 3 is a partial cross-sectional, side elevational view of the key operator shown in FIG. 1 in an extended position.

Referring now more specifically to the drawings and in particular FIG. 1, a key operator 10 embodying the features of the present invention is shown.

The key operator 10 is movable between the retracted or storage position 14 shown in FIG. 1 and the extended position 16 shown in FIG. 3. The key operator 10 includes a handle 18, an inner extension arm 20, and an outer extension arm 22 as seen in FIG. 3. The handle 18 has a pivot end portion 24 which is pivotally connected to the first end portion 26 of the inner extension arm 20 by the pivot means 28. The other end portion 30 of the inner extension arm 20 is pivotally connected to the pivot end portion 32 of the outer extension arm 22 by the pivot means 34. The outer extension arm 22 has a key retaining end portion 36 to which a key 38 is attached. It should be understood that the key 38 may be a metal key, a plastic or metallic key card or any other type of key which allows for operation of a lock.

In the retracted or storage position 14 shown in FIG. 1, the arms 20, 22 are positioned adjacent to the handle 18. In the extended position 16, shown in FIG. 3, the key retaining end portion 36 and the arms 20, 22 are extended from the handle 18 to allow for operation of the key 38 a distance from the hand of a person holding and manipulating the handle. The key operator 10 is shown in FIG. 2 in a position 40 intermediate the retracted position 14 and the extended position 16.

To synchronize and control the angular movement of the handle 18 and the outer extension arm 22, means 42 are provided for connecting the handle 18 and the outer extension arm 22. The connecting means 42 includes a pulley 44 secured to the handle 18 and a pulley 46 secured to the outer extension arm 22. The connecting means 42 also includes a belt 48 positioned around the pulleys 44, 46. The pulleys 44, 46 have a series of timing slots 50 about their periphery and the belt 48 has a series of cleats 52 which are positionable in the slots 50 of the pulleys. Accordingly, when the arms 20, 22 are moved with respect to the handle 18, the angular position of the outer arm 22 is controlled by the connecting means 42.

The key operator 10 of the present invention also includes means 54 for locking the handle 18 and the arms 20,22 in either the retracted or extended positions 14, 16 respectively. The locking means 54 includes a locking member 56 pivotally mounted on the handle 18. The locking member 56 has a locking projection 58 positioned adjacent to the end 26 of the arm 20 which end portion has a storage locking depression 60 and an extended locking depression 62. When the operator 10 is in the storage or retracted position 14, the locking projection 58 is received in the locking depression 60 to retain the inner extension arm 20 in the storage position. The connecting means 42 connects the outer extension arm 22 to the handle 18 and retains the outer extension arm in the storage position 14. In the extended position 16, the locking projection 58 is positioned in the extended locking depression 62 and locks the inner extension arm 20 in the extended position 16 with respect to the handle 18. The connecting means 42 locks the movement of the outer extension arm 22 with respect to the handle 18.

As can be seen from the above, the locking means 54 including the connecting means 42, operates to provide a key operator 10 that is rigid in the extended position 16 so that the key 38 retained on the key operator may be moved and rotated by a person's hand. When the person grasps the handle 18, the key operator 10 serves as an extension of the person's hand to allow the key 38 to be used a distance from his hand.

Furthermore, when in the extended position 16, the key operator 10 of the present invention provides for a substantial extension of the key 38 a substantial distance from the person's hand. The key is extended the cumulative distance of the pivotally connected handle 18 and arms 20 and 22 to provide a substantial extension.

The key operator 10 of the present invention is collapsible to a compact size so that the key operator may be easily carried or stored. By folding the arms 20, 22 into the storage position 14 adjacent the handle 18, the key operator 10 is compact and may be easily carried.

The key 38 is retained on the outer extension arm 22 by any known retaining means 63 such as a threaded fastener 64 and cooperating threaded nut 66 shown in FIG. 3. The outer extension arm 22 has a generally "L" shaped configuration with a side portion 68 and a bottom flange portion 70. The threaded fastener 64 extends through the key retaining portion 36 of the side portion 68 and through an opening in the key 38. The threaded nut 66 is threaded onto the fastener 64 and secures the key 38 to the key retaining portion 36 of the outer extension arm 22.

It should be understood that a wide variety of key devices, including key cards, may be secured to the key retaining portion 36 of the outer extension arm 22. As can be seen in FIG. 3, the bottom flange portion 70 stops short of the end of the key retaining end portion 36 so as to allow a key card to be retained thereon. It is within the contemplation of this invention that a key card may be attached to the key retaining end portion 36 by any known means, such as a clamp secured to the arm 22 by means of the cooperating threaded members 64, 66. By stopping the flange portion 70 short of the end of the key retaining portion 36, a card may extend outwardly of the top and bottom surfaces 72, 74 respectively of the outer arm 22.

When the key operator 10 is in the extended position 16 as shown in FIG. 3, the key 38 is rigidly connected to the handle 18 by the arms 20, 22 by the cooperative locking action of the locking means 54 including the connecting means 42. The locking member 56 is pivotally connected to the pivot end portion 24 of the handle 18. As seen in FIGS. 3 and 4, the handle 18 is generally channel shaped with opposing side portions 78, 80 connected by the top portion 82. The side portions 78, 80 extend the length of the handle 18 from the pivot end portion 24 to the opposing end 84 of the handle. The opposing end 84 of the handle 18 includes an end cap portion 86 which extends between the side portions 78, 80 and top portion 82.

The locking member 56 of the locking means 54, as seen in FIGS. 4 and 5, includes a pin 76 for pivotally connecting the locking member 56 to the handle 18. The pin 76 is positioned in an opening 88 extending through the opposing side portions 78, 80 adjacent to the top portion 82 of the handle 18. On one side of the pivot pin 76, the locking member 56 has an arm 90 extending therefrom which terminates in the locking projection 58. The locking projection 58 extends away from the top portion 82 of the handle 18 and towards the arm 20. As can be seen in FIG. 4, the arm portion 90 is positioned between the opposing side portions 78, 80 and is adjacent to the side portion 80 and offset with a space, generally indicated at 92, between the arm 90 and the side portion 78.

The offset positioning of the arm portion 90 with respect to the side portion 78 allows a key card to be retained on the outer extension member 22. When a key card is used with the operator 10, the key card may extend through the slot 94 in the handle 18 when the key operator 10 is in the storage position 14 as will be hereinafter more fully described.

On the other side of the pin 76, the locking member 56 includes a manually operable portion 96 for use by a person using the key operator 10. The manually operable portion 96 extends upwardly towards and through an opening 98 in the top portion 82 of the handle 18 as seen in FIG. 2. The manually operable portion 96 of the locking member 56 includes stop portions 100 as seen in FIG. 4. The stop portions 100 contact the lower surface 102 of the top portion 82 of the handle 18 to control the movement of the manually operable portion 96 of the locking member 56 through the top portion of the handle.

The exterior portion 106 of the locking member 56 also includes a stop surface 110 which limits the distance of movement of the locking member. When the locking member 56 is manually depressed by exerting force on the surface 108, the stop surface 110 contacts the top surface 104 of the handle 18 to thereby limit excessive movement of the locking member 56.

An exterior portion 106 of the manually operable portion 96 of the locking member 56 extends outwardly of the top surface 104 of the top portion 82 of the handle 18. The exterior portion 106 includes a manually operable surface 108 which may be manually depressed by a person to consequently move the locking projection 58 towards the upper channel portion 82 of the handle 18 and release the arm 20 from a locked relationship with respect to the handle 18.

As seen in FIGS. 2 and 4, the locking means 54 also includes a spring 112 to bias the locking projection 58 into a locking position in engagement with one of the depressions 60, 62. When a force is exerted on the surface 108 sufficient to overcome the bias force of the spring 112, the locking projection 58 moves into an unlocked position out of one the depressions 60, 62 and allows the arms 20, 22 to move with respect to the handle 18 between the storage and extended position 14, 16 respectively.

The spring 112 is positioned between a locking member 56 and the side portion 80 of the handle 18 as seen in FIGS. 4 and 5. To provide for a space 114 between the arm 90 and manually operable portion 96 of the locking member 56, a spacer 116, such as a washer or an integral extension of the locking member 56, is positioned around the pin 76 between the portion 96 and the side 80 of the handle 18. One end 118 of the spring 112 extends in the direction of the arm 90 and terminates in an end 120 in contact with the lower surface 102 of the top portion 82 of the handle 18. The central portion 122 of the spring 112 is positioned between the spacer 116 and the lower surface 102 of the top portion 82 of the handle 18.

The other end 124 of the spring 112 is connected to the manually operable portion 96 of the locking member 56 by a connecting portion 126 extending towards and into an opening 128 in the manually operable portion 96 of the locking member 56. The opening 128 is positioned so that the spring 112 urges the locking projection 58 toward a locked position and maintains a biasing force on the locking projection. When a sufficient force is exerted by a person on the manually operable surface 108 of the locking member 56, the bias force created by the spring 112 is overcome. The locking projection 58 is then moved to an unlocked position towards the top portion 82 of the handle 18 and out of one of the depressions 60, 62 so that the arms 20, 22 may be moved with respect to the handle 18.

As seen in FIGS. 6 and 7, the end portion 26 of the inner extension arm 20 is pivotally connected to the handle 18 by the pivot means 28. The pulley 44 has a generally rectangular locking boss 130 with outer peripheral surfaces 132. The locking boss 130 terminates in a bearing portion 134 having a generally cylindrical bearing surface 136. The bearing portion 134 terminates in a belt retaining portion 138. The belt retaining portion 138 includes a pair of spaced belt bearing portions 140, 142 with a spacing portion 144 therebetween. The outer surfaces 146, 148 of the belt bearing portions 140, 142 respectively have a generally cylindrical shape with slots 50 including depressions 150, 152 spaced about the periphery of the belt bearing portions 140, 142 respectively. The belt retaining portion 138 terminates in a bearing portion 154 having a generally cylindrical surface 156.

It should be understood that the pulley 46 is constructed similar to the pulley 44 described in connection with FIG. 7. For ease of description, similar numerals will be used in describing similar features and parts of the pulley 46 as the numeral used in connection with the pulley 44 followed by a prime (').

The pivot means 26 pivotally connects the arm 20 to the handle 18. The pulley 44 is secured to the handle 18 and the intermediate arm 20 is pivotally mounted on the pulley 44. To secure the pulley 44 to the handle 18, a threaded fastener 158 is received in the opening 160 in the side channel portion 80 on the pivot end portion 24 of the handle 18. The inner surface 162 of the side portion 80 of the handle 18 has a rectangular depression 164 having a geometric configuration complimentary to the locking boss 130 of the pulley 44. The depression 164 is shaped to received the locking boss 130 therein and secure the pulley 44 from rotation with respect to the handle 18. The pulley 44 has a threaded opening 166 therein for threadedly receiving the fastener 158 therein. The threaded opening 166 is in alignment with the opening 160. When the threaded fastener 158 is positioned in the aligned openings 160 and 166, the pulley 44 is secured to the side portion 80 of the handle 18.

The end 26 of the inner extension arm 20 is pivotally mounted on the pulley 44. When the pulley 44 is secured to the handle 18, the inner extension arm 20 rotates about the pulley and consequently the handle. The inner arm 20, as seen in FIGS. 6, 8, 9 and 10, includes complimentary side members 168, 170.

It should be understood that the side members 168, 170 of the arm 20 are similar in construction. For ease of description, the side member 168 as shown in FIGS. 8 and 9 will be described in detail herein and similar numerals will be used in describing similar features of the parts of the side member 170 as the numerals used in connection with the side member 168 followed by a prime (').

The side member 168 of the inner extension arm 20, as seen in FIGS. 8, 9 and 10, defines a portion of the end portions 26, 30 of the inner extension arm. The side member 168 is a generally channel shaped member extending between and defining a portion of the end portions 26, 30. The side member 168 has a bottom portion 172 and side channel portions 174, 176.

Means 177 are provided for securing the side member 168, 170 together to form the inner extension arm 20. Spaced along one side of the bottom portion 172 and between the channel portions 176, 174 are a series of bosses 178 having attachment protrusions 180 thereon. The attachment protrusions 180 are positioned a predetermined distance from the side member 168. The side member 168 has a series of protrusion receiving bosses 182 each of which have a protrusion receiving depression 184 therein. The protrusion receiving depressions 184 are positioned a predetermined distance from the channel portion 174 which is equal in distance to the predetermined distance between the protrusions 180 and the channel portion 176.

A belt receiving guide slot 186 as seen in FIG. 10 is provided between the channel portion 176 and the bosses 178 to allow the belt 48 to be positioned therebetween. A belt receiving guide slot 188 is provided between the protrusion receiving bosses 182 and the channel portion 174 to receive the belt 48 therebetween. The belt receiving guide slots 186, 188 allow the belt 48 to be positioned around the pulleys 44, 46 as seen in FIG. 8 and guide the belt as it moves around the pulleys. It should be understood that the complimentary protrusions 180 and protrusion receiving depressions 184 may be positioned in any configuration that allows the protrusions 180 to be received in the depressions 184 when the channel portions 174, 176 are assembled while providing for the belt receiving guide slots 186, 188.

To rotatably mount the end portion 26 of the arm 20 on the pulley 44, the side member 168 has an opening or bearing surface 190 therein which defines a bearing surface shaped complimentary to the cylindrical bearing portion 156 of the pulley 44, shown in FIGS. 6 and 7. The side member 170 has an opening or bearing surface 192 which defines a bearing surface complimentary to the cylindrical bearing surface 136 of the bearing portion 134 of the pulley 44.

The other end portion 30 of the arm 20, as seen in FIG. 11, is similarly pivotally secured to the pulley 46. The other end 30 of the side member 168 has an opening or a bearing surface 190' which rotatably receives the bearing portion 134' about the cylindrical bearing surface 136'. The other side member 170 has an opening or a bearing surface 192' which rotatably receives the cylindrical bearing portion 156' of the pulley 46 as seen in FIG. 11.

The pulley 46 is secured to the outer extension arm 22. To allow the outer extension arm 22 to retract to a storage position 14 adjacent to and inside the handle 18 as will be more fully described, a spacer boss 194 is provided on the upwardly extending side portion 68. The boss 194 spaces the pulley 46 a sufficient distance away from the side portion 68 of the outer extension member 22 to allow for positioning the arms 20, 22 to be in the stored position 14 adjacent to and inside of the handle 18. The boss 194 has a locking depression 196 therein which has a configuration complimentary to the configuration of the locking boss 130' on the pulley 46. An opening 198 is provided through the side portion 68 and boss 194 of the arm 22 in alignment with the threaded opening 166' in the pulley 46. A threaded fastener 200 is positioned through the openings 198, 166' and secures the pulley 46 to the outer extension arm 22. The complimentary depression 196 receives locking boss 130' and restrains rotation of the pulley 46 with respect to the arm 22.

It should be understood that it is within the contemplation of this invention to secure the pulleys 44, 46 to their respective members to which they are attached, 18, 22 respectively by any known means.

The belt 48, as shown in FIGS. 12 and 13, is provided to connect the pulleys 44, 46. The belt 48 is an endless belt having a generally T-shaped cross-sectional configuration. The belt 48 has a top portion 202 and a downwardly extending guide portion 204 extending from the center of the top portion 202 toward the inside of the belt. The guide portion 204 terminates in a bottom surface 208. A series of cleats 52 are formed in the belt 48 and extend from the top portion 202 in the direction of the guide portion 204. The cleats 52 extend across the top portion 202 the width of the belt and terminate in a bottom surface 206 positioned a greater distance from the top portion 202 than the bottom surface 208 of the guide portion 204 of the belt 48.

The cleats 52 are provided to cooperate with the slots 50, including the locking depressions 150, 152 and 150', 152' of the pulleys 44, 46 respectively, as seen in FIG. 8. The guide portion 204 is of a width substantially equal to the width of the spacing portions 144 and 144' of the belts 44, 46 respectively and is received therein, as seen in FIGS. 8, 11, 12 and 13. The guide portion 204 of the belt 48 operates to guide the belt during operation of the operator 10 and keep the cleats 52 in alignment with the slots 50.

The spacing of the slots 50, of the pulleys 44, 46 and the spacing of the cleats 52 on the belt 48 are complimentary to each other, shown in FIGS. 7 and 8. The cleats 52 are positioned a distance from each other equal to the arcuate distance between the locking depressions 150 and 152 on the pulley 44 and the locking depressions 150' and 152' on the pulley 46. When the components of the operator 10 are assembled, the pulleys 44, 46 and belt 48 cooperate to coordinate the movement between the outer extension arm 22 and the handle 18.

To assemble the arm 20 and pulleys 44, 46 with the handle 18 and the outer extension arm 22, the pulleys 44, 46 are positioned in one of the side members 168, 170. One of the pulleys 44, 46 has its locking boss 130, 130' positioned through one of the openings 190 or 190' respectively, and the other pulley is positioned in the opposite direction. The belt 48 is positioned around the pulleys 44, 46 with the guide portion 204 received in the spacing portions 144 and 144' and the cleats 52 of the belt positioned in the depressions 150, 152 and 150' and 152' of the slots 50. The ends 26, 30 of the side members 168, 170 are formed with the channel portions 174, 176 having an arcuate shape around the openings 190, 192 and 190' and 192' so that when the belt 48 is positioned around the pulleys 44, 46 the arcuate portion or the ends 26, 30 of the arm 20 retain the belt.

The side members 168, 170 are then joined together by applying an adhesive to the protrusions 180, 180' and depressions 184, 184'. When the protrusions 180, 180' are inserted in their respective depressions 184', 184, the side members 168, 170 are secured together with the pulleys 44, 46 and the belt 48 positioned therein.

The handle 18 and arms 20, 22 are assembled by securing the pulley 44 to the handle 18 with the threaded fastener 158 as above described. The arm 20 is secured to the outer arm 22 by threadedly securing the pulley 46 to the outer arm 22 with the threaded fastener 200 as above described.

In operation, the key 38 is secured to the key retaining end portion 36 of the outer extension arm 22. It should be understood that the key 38 may include a key card or other key operating device.

In the storage position 14, the key operator 10 has a compact configuration which allows for easy storage and carrying of the operator in a minimum space. In the storage position 14 as seen in FIG. 1, the arms 20, 22 are stored within the cavity 210 formed by the opposing side portions 78, 80 and top portion 82 of the handle 18. The opposing end portion 84 of the handle 18 terminates in the end cap portion 86. As seen in FIG. 4, when the key 38 is attached to the arm 22 and positioned in the storage position 14, the key is in alignment with slot 94 which allows for mounting a key card on the arm 22 when the operator 10 is in the storage position.

In the storage position 14, the inner extension arm 20 is positioned adjacent to the side portion 80 of the handle while the outer extension arm 22 is positioned adjacent to the side portion 78. By positioning the arms 20, 22 adjacent to each other and in the cavity 210 in the handle 18, a compact configuration is achieved when the operator 10 is in the storage position 14.

The lower flange 70 of the arm 22 covers the cavity 210 of the handle 18 when in the storage position 14 to protect the components of the operator 10. The lower flange portion 70 of the outer extension arm 22, as seen in FIGS. 1 and 3, extends across the space between the open ends of the sides 78, 80 of the handle 18 when the key operator 10 is in the storage position 14. Accordingly, the operator 10 provides a compact key operator with a shape that is convenient to carry when in the storage position 14. In the storage position 14, five sides of the operator are substantially enclosed by the top portion 82, side portions 78, 80 end cap portion 86 of the handle 18 and the flange 70 of the arm 22. By providing a relatively smooth outer configuration in the storage position, the key operator 10 may be readily and conveniently carried or stored. The arms 20, 22 are locked and retained in the cavity 210 of the handle 18 when in the storage position 14 by the locking means 54 including the connecting means 42. To lock the inner extension arm 20 in the storage position, the spring 112 urges the locking projection 58 into the storage locking depression 60 in the arm 20 to lock rotational movement of the arm 20 with respect to the handle 18. The handle 18 has a stop portion 212 extending from the top portion 82 of the handle. The end portion 30 of the arm contacts the stop 212 to further prohibit movement of the arm 20 with respect to the handle 18.

When the operator 10 is in the storage position 14 and the projection 58 is in locking engagement with the depression 60, the connecting means 42 operates to lock the outer extension arm 22 in the storage position in the handle 18. The pulley 44 is secured to the handle 18 and the pulley 46 is secured to the outer extension arm 22. The belt 48 is positioned around the pulleys 44, 46 and locks angular movement of the arm 22 with respect to the handle 18. Since the pulley 46 is pivotally mounted on the arm 20 and the arm 20 is locked with respect to the handle 18, the arm 22 is thereby secured in the storage position.

When it is desirable to move the arms 20, 22 from the storage position 14 to the extended position 16, the person using the operator 10 manually exerts a force on the surface 108 of the lock member 56, as seen in FIGS. 1, 2 and 4. The locking projection 58 is raised out of the storage locking slot or depression 60. The person using the operator 10 then moves the outer arm 22 away from the handle 18 and consequently rotates the arm 20 with respect to the handle 18. At this point the locking member 56 may be released and the projection 58 contacts and rides on the circular outer surface 214 of the end portion 26 of the arm 20 as seen in FIG. 2.

As the person continues to move the outer extension arm 22 towards the extended position 16 shown in FIG. 3, the belt 48 moves about the pulleys 44, 46 with the cleats 52 engaging the slots 50 of the pulleys. Accordingly, the belt 48 maintains the handle 18 and the outer extension arm 22 substantially parallel to each other and locks the angular position of the handle and outer extension arm.

The person using the operator 10 continues to move the arms 20, 22 to the extended position 16 as shown in FIG. 3. When the arms 20, 22 reach the extended position 16 with respect to the handle 18, the locking projection 58 of the locking means 54 engages the extended locking depression 62 to lock the arm 20 with respect to the handle 18 and prohibit angular movement of the arm 20 with respect to the handle 18. The connecting means 42 operates to lock angular movement of the outer extension arm 22 with respect to the handle 18. Since the end portion 30 of the inner extension arm 20 is locked with respect to the handle 18, the outer extension arm 22 is also locked with respect to the handle 18 to provide a rigid structure which may be utilized to operate the key 38 a distance from the handle.

The person then grips the handle 18 and inserts the key 38 in the lock to be operated and operates the lock. After the lock has been operated, the person may move the arms 20, 22 into a retracted or storage position 14 within the handle 18 as seen in FIG. 1 by the reverse steps described above in connection with moving the operator 10 from the storage position 14 to the extended position 16.

Having described my invention, I claim:

1. An extendable key operator comprising:

a. a handle having a pivot end portion;

b. an inner extension arm having first and second end portions, said first end portion pivotally connected to said pivot end portion of said handle;

c. an outer extension arm having pivot end and key retaining end portions, said pivot end portion of said outer extension arm pivotally connected to said second end portion of said inner extension arm, said handle and said arms movable between an extended position in which said key retaining end portion of said outer extension arm and said arms extended from said handle and a retracted position in which said arms are positioned adjacent to said handle;

d. means for connecting said handle and said outer extension arm to synchronize and control the angular movement of said handle and said outer extension arm, said connecting means including a first pulley secured to said handle, a second pulley secured to said outer extension arm and a belt positioned around said first and second pulleys, each of said first and second pulleys having at least one slot, said belt having a plurality of cleats, at least one of said cleats positioned in at least one slot of said first pulley and at least one of said cleats positioned in at least one slot of said second pulley as said handle and arms are moved between the retracted position and the extended position.

2. An extendable key operator described in claim 1 including means for locking said handle and said arms in the retracted and the extended positions including a locking member having a locking projection, said locking member movably mounted on said handle with said locking projection adjacent said first end portion of said inner extension arm, said first end portion of said inner extension arm having a first locking depression which receives said locking projection of said locking member when the extendable key operator is in the retracted position and a second locking depression which receives said locking projection of said locking member therein when the extendable key operator is in the extended position.

3. An extendable key operator as described in claim 2 in which said locking member is pivotally connected to said handle for movement of said locking projection into engagement with one of said first and said second locking depressions on said inner extension arms.

4. An extendable key operator as described in claim 2 in which said locking means includes spring means for biasing said locking projection into engagement with one of said first and said second locking depressions in said inner extension arm.

5. An extendable key operator as described in claim 1 in which said inner extension arm includes a slot extending between said first and second end portions thereof for receiving said pulleys and said belt therein.

6. An extendable key operator as described in claim 1 in which said first pulley has a portion rotatably received by said first end portion of said inner extension arm and secured to said handle and in which said second pulley has a portion rotatably received by said second end portion of said inner extension arm.

7. An extendable key operator as described in claim 1 in which said belt includes a guide portion and said first and second pulleys having a groove which receives said guide portion of said belt.

8. An extendable key operator as described in claim 1 which includes means for retaining a key on said key retaining end portion of said outer extension arm.

9. An extendable key operator as described in claim 1 in which said handle includes opposing side portions and a top portion extending between said side portions, said outer and inner arm positioned between said opposing side portions and adjacent to said top portion of said handle when in the retracted postion.

10. An extendable key operator comprising:

a. A handle having a pivot end portion;

b. an inner extension arm having first and second end portions, said first end portion pivotally connected to said pivot end portion of said handle;

c. an outer extension arm having a pivot end and key retaining end portions, said pivot end portion of said outer extension arm pivotally connected to said second end portion of said inner extension arm, said handle and said arm movable between an extended position in which said key retaining end portion of said outer extension arm and said arms extended from said handle and a retracted position in which said arms are positioned adjacent to said handle; and d. means for locking said handle and said arms in both the retracted and the extended positions including means for connecting said handle and said outer extension arm to synchronize and control the angular movement of said handle of said outer extension arm and a locking member having a locking projection, said locking member movably mounted on said handle with said locking projection adjacent said first end portion of said inner extension arm, said first end portion of said inner extension arm having a first locking depression which receives said locking projection of said locking member when the extendable key operator is in the retracted position and a second locking depression which receives said locking projection of said locking member when the extendable key operator is in the extended position.

11. An extendable key operator as described in claim 10 in which said locking member is pivotally connected to said handle for movement of said locking projection into engagement with one of said first and said second locking depressions on said inner extension arm.

12. An extendable key operator as described in claim 10 in which said locking means includes spring means for biasing said locking projection into engagement with one of said first and said second locking depressions in said inner extension arm.

13. An extendable key operator as described in claim 10 in which said connecting means includes a first pulley secured to said handle, a second pulley secured to said outer extension arm and a belt positioned around said first and second pulley, each of said first and second pulleys having at least one slot, said belt having a plurality of cleats, at least one of said cleats positioned in at least one slot of said first pulley and at least one of said cleats positioned in at least one slot of said second pulley as said handle and arms are moved between the retracted position and the extended position.

14. An extendable key operator as described in claim 13 in which said inner extension arm includes a slot extending between said first and second end portions thereof for receiving said pulleys and said belt therein.

15. An extendable key operator as described in claim 13 in which said first pulley has a portion rotatably received in an aperture in said first end portion of said inner extension arm and secured to said handle and in which said second pulley has a portion rotatably received in an aperture in said second end portion of said inner extension arm.

16. An extendable key operator as described in claim 13 in which said belt includes a guide portion and said first and second pulleys having a groove which receives said guide portion of said belt.

17. An extendable key operator in claim 13 which includes means for retaining a key on said key retaining end portion of said outer extension arm.

18. An extendable key opertor as described in claim 10 in which said handle includes opposing side portions and a top portion extending between said side portions, said outer and inner arm positioned between said opposing side portions and adjacent to said top portion of said handle when in the retracted position.

* * * * *